US007238630B2

(12) United States Patent
Steagall et al.

(10) Patent No.: US 7,238,630 B2
(45) Date of Patent: Jul. 3, 2007

(54) CUSHION HAVING PLURAL ZONES WITH DISCRETE COMPRESSIBILITY CHARACTERISTICS

(75) Inventors: D. Patrick Steagall, Mooresville, NC (US); Steven E. Ogle, Murphreesboro, TN (US); Philip S. Kaylor, Claremont, NC (US); Karl Van Becelaere, Nashville, TN (US)

(73) Assignee: L&P Property Management Company, South Gate, CA (US)

( * ) Notice: Subject to any disclaimer, the term of this patent is extended or adjusted under 35 U.S.C. 154(b) by 613 days.

(21) Appl. No.: 10/773,832

(22) Filed: Feb. 5, 2004

(65) Prior Publication Data

US 2004/0222685 A1 Nov. 11, 2004

Related U.S. Application Data

(60) Provisional application No. 60/445,128, filed on Feb. 5, 2003.

(51) Int. Cl.

| | |
|---|---|
| ***B32B 3/26*** | (2006.01) |
| ***B32B 5/14*** | (2006.01) |
| ***B32B 5/18*** | (2006.01) |
| ***B32B 5/24*** | (2006.01) |
| ***B32B 7/02*** | (2006.01) |

(52) U.S. Cl. ..... 442/74; 428/71; 428/76; 428/309.9; 428/316.6; 428/218; 442/370; 442/372; 442/373; 442/381

(58) Field of Classification Search ..... 428/306.6, 428/309.9, 316.6, 74, 76, 310.5; 442/370, 442/372, 373; 5/952, 953, 636, 652, 655.9
See application file for complete search history.

(56) References Cited

U.S. PATENT DOCUMENTS

| | | | | |
|---|---|---|---|---|
| 2,500,282 | A | 3/1950 | Francis, Jr. | 154/101 |
| 4,110,881 | A | 9/1978 | Thompson | 29/91.1 |
| 4,131,664 | A | 12/1978 | Flowers et al. | 423/447.5 |
| 4,668,562 | A | 5/1987 | Street | 428/218 |
| 4,753,693 | A | 6/1988 | Street | 156/62.8 |
| 4,818,586 | A | 4/1989 | Smith et al. | 428/198 |
| 5,061,538 | A | 10/1991 | Hendrix et al. | 428/74 |
| 5,079,074 | A | 1/1992 | Steagall et al. | 428/218 |
| 5,525,407 | A | 6/1996 | Yang | 428/218 |
| 5,532,050 | A | 7/1996 | Brooks | 428/220 |
| 5,579,549 | A | 12/1996 | Selman et al. | 5/721 |
| 5,604,021 | A | 2/1997 | Wagner | 428/218 |
| 5,609,947 | A | 3/1997 | Kamei et al. | 428/212 |
| 5,741,380 | A | 4/1998 | Hoyle et al. | 156/62.6 |
| 6,063,461 | A | 5/2000 | Hoyle et al. | 428/34.5 |
| 6,269,504 | B1 | 8/2001 | Romano et al. | 5/690 |
| 6,331,345 | B1 | 12/2001 | Kauschke et al. | 428/156 |

*Primary Examiner*—Jenna Befumo
(74) *Attorney, Agent, or Firm*—Conley Rose, P.C.; Kristin Jordan Harkins

(57) ABSTRACT

A seat cushion or other resilient structure includes a foam inner core combined with layers of varying density fiber batts to impart desirable comfort characteristics, support features and durability thereto. In one embodiment, the foam core is positioned between intermediate layers of low loft fiber batts of relatively high densities. In turn, the intermediate batts are sandwiched between outer high loft fiber batts having relatively low densities. Alternately, the foam core comprises one or more intermediate layers of relatively high density fiber batts that are positioned within the foam core to create one or more fiber batt subcores. The outer high loft fiber batts sandwich the foam core comprising the fiber batt subcores to create the resilient structure.

20 Claims, 3 Drawing Sheets

CUSHION HAVING PLURAL ZONES WITH DISCRETE COMPRESSIBILITY CHARACTERISTICS

CROSS-REFERENCE TO RELATED APPLICATIONS

This application is related to, and claims priority based upon, U.S. Provisional Patent Application Ser. No. 60/445,128, filed Feb. 5, 2003.

STATEMENT REGARDING FEDERALLY SPONSORED RESEARCH AND DEVELOPMENT

Not Applicable.

REFERENCE TO A MICROFICHE APPENDIX

Not Applicable.

FIELD OF THE DISCLOSURE

The present disclosure relates to a resilient structure, such as a seat cushion, a furniture back, a comforter or a pillow, for enhanced personal comfort. The resilient structure comprises multiple layers of non-woven fiber batt and a foam inner core for enhanced resilience, compressibility, support and durability in strategic areas. The resilient structure provides both support for a given load, typically, a user sitting or otherwise putting weight on the resilient structure, as well a degree of comfort to the user. The resilient structure is also durable so that its support and comfort features withstand prolonged wear.

BACKGROUND

Nonwoven fiber batts are useful as filler materials in personal comfort items. A high loft fiber batt, which generally has a relatively low density, is desirable for its cushioning ability and soft, plush feel to the touch. The high loft batt has a large amount of air space held within the batt materials. The air space defined within the fiber batt acts as a thermal insulation layer, and the batt's resilience, compressibility and softness provide a degree of comfort. High loft fiber batts are, however, somewhat susceptible to flattening out and lose compressibility and resilience over a period of use. A low loft fiber batt, on the other hand, generally has relatively high density to provide sufficient firmness or rigidity to impart a degree of support and durability for long term wear. The relatively high density fiber batt provides back, seat or body support to one seated or reclining on the furniture, or otherwise using the personal comfort item. In addition, the relatively high density fiber batt provides stability to the personal comfort item. The relatively high density fiber batt, however, has little air space and thus is somewhat uncompressible and less comfortable than a high loft batt.

Foam materials are also useful in the construction of seat cushions, furniture backs, comforters, pillows and other personal comfort items. Traditional foam material includes flexible polyurethane foam. While foam imparts cushioning and resilience, it is relatively firm and thus suitable for applications where support is desirable to one using the personal comfort item. Over a period of wear, however, the foam loses its resilience and can disintegrate, resulting in a foam product that is hard and flat.

SUMMARY

In accordance with the teachings of the present invention, the features of high loft/low density fiber batts, low loft/high density fiber batts and foam are combined to produce a resilient structure, such as a seat cushion, a furniture back, a comforter or a pillow, configured to provide enhanced personal comfort to a user of the resilient structure. In one embodiment, the resilient structure comprises a foam inner core combined with layers of varying density fiber batts to impart desirable comfort characteristics, support features and durability to the resilient structure. In another embodiment, the foam core is positioned between intermediate layers of low loft fiber batts of relatively high densities. The intermediate batts are sandwiched between outer high loft fiber batts having relatively low densities. Alternatively, the foam core comprises one or more intermediate layers of relatively high density fiber batts that are positioned within the foam core to create one or more fiber batt subcores. The outer high loft fiber batts sandwich the foam core comprising the fiber batt subcores to create the resilient structure. Upholstery or other material or fabric can be used to cover the resilient structure to provide a decorative seat cushion, furniture back, comforter or pillow.

In the foregoing embodiment, the use of relatively dense intermediate fiber batt layers to sandwich the fiber core or as a fiber subcore enhances overall support to the resilient structure to handle a given load. It is noted, however, that additional or other zones of support can be created in the resilient structure by the strategic placement of the intermediate fiber batt layers. More specifically, in another embodiment of the resilient structure, intermediate layers can be provided in the front area of a seat cushion to provide knee support, in the back area to provide support to a person's posterior or in the proximate side areas of a seat cushion to enhance the durability of the seat cushion.

BRIEF DESCRIPTION OF THE DRAWINGS

For a more complete understanding of the present invention, and for further details and advantages thereof, reference is now made to the accompanying drawings, in which.

Figure 2:
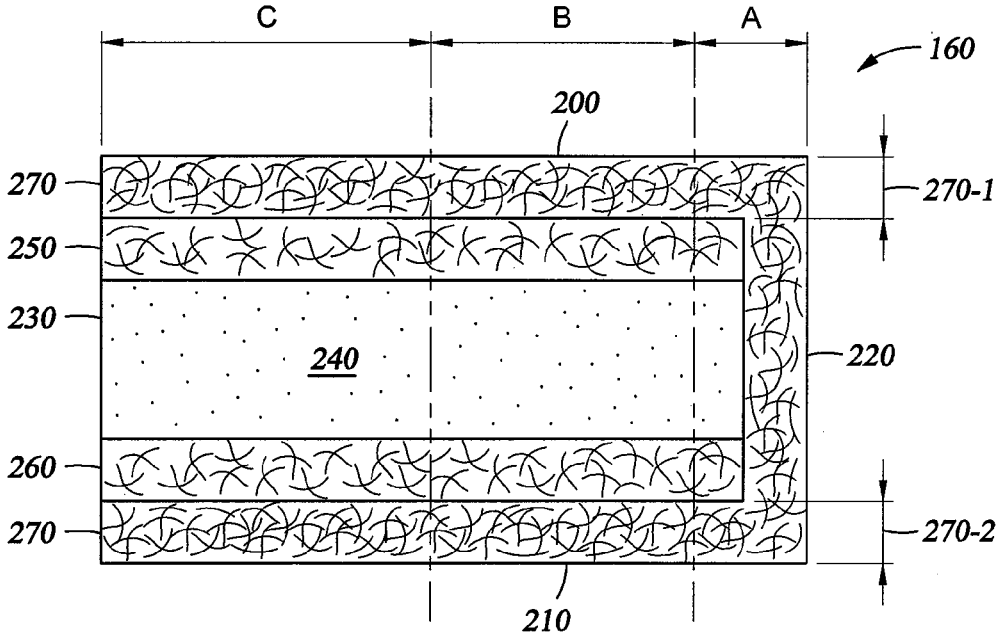
FIG. 2 is a cross-sectional view, taken across lines 2—2 thereof, of the cushion of FIG. 1
Figure 3A:
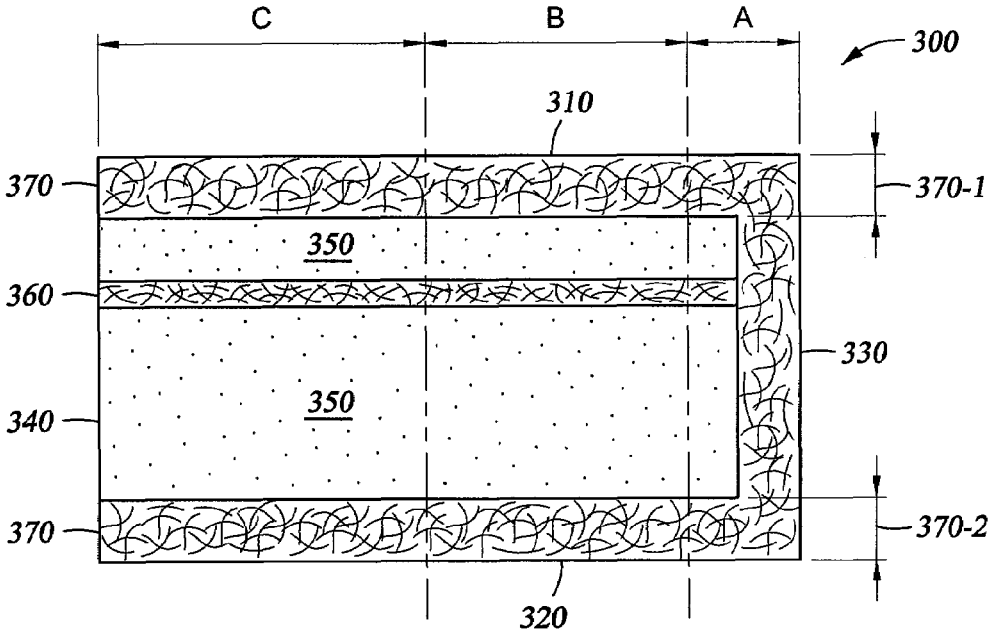
FIG. 3A is a first cross-sectional view of a first alternate embodiment of the cushion of FIG. 2.
Figure 4:
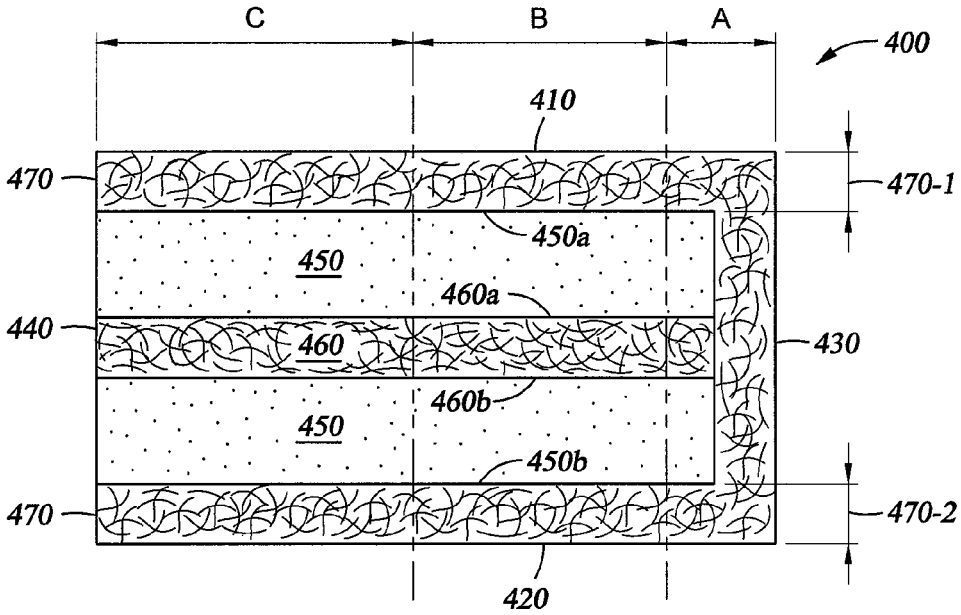
Figure 5:
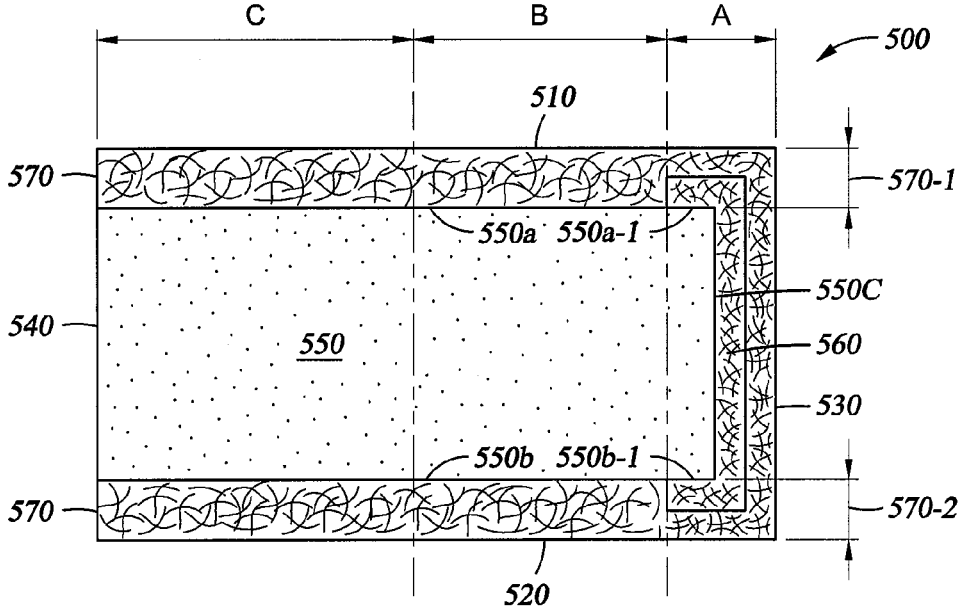

FIB. 3B is a second cross sectional view of cushion of FIG. 3A after pivoting the cushion approximately 180 degrees in a first axis;

FIG. 4 is a cross sectional view of a second alternate embodiment of the cushion of FIG. 2; and FIG. 5 is a cross sectional view of a third alternate embodiment of the cushion of FIG. 2.

DETAILED DESCRIPTION

Figure 1:
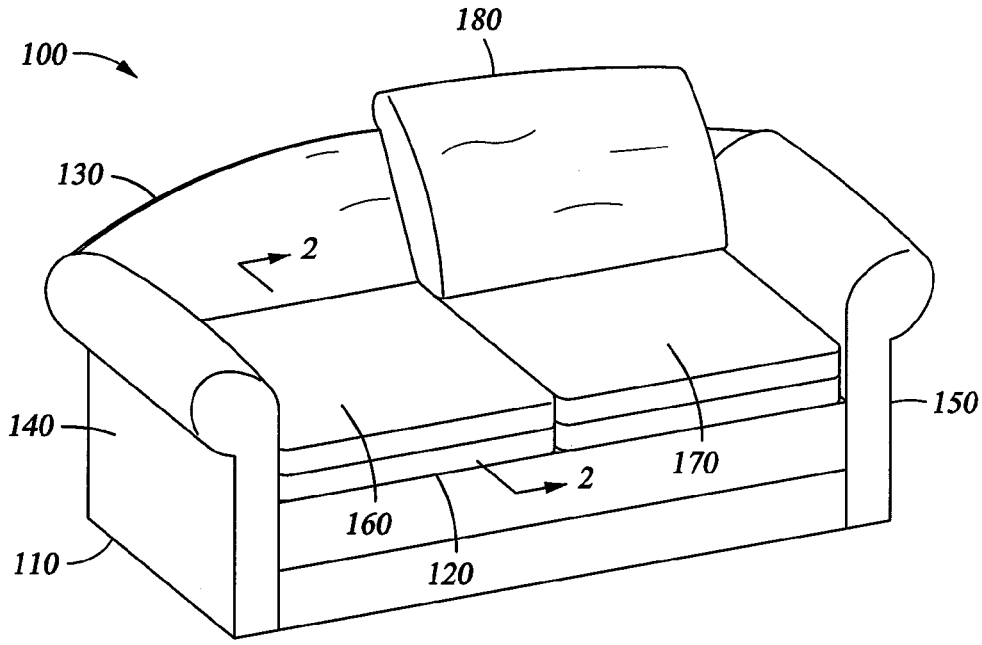
FIG. 1 is a perspective view of a furniture seating system which incorporates therein, a cushion constructed in accordance with the teachings of the present invention.

Referring first to FIG. 1, a furniture seating system 100, for example, a sofa or loveseat, which incorporates therein, first and second resilient structures 160 and 170, for example, seat cushions, constructed in accordance with the teachings of the present invention will now be described in detail. Of course, while, as disclosed herein, the furniture seating system 100 in which the first and second cushions 160 and 170 constructed in accordance with the teachings of the present invention are incorporated is a sofa, it is fully contemplated that a wide variety of other furniture seating systems, for example, futons, loveseats, chairs, recliners, ottomans and stools may also incorporate the novel cushion disclosed herein. It is further contemplated that these and other types of furniture seating systems may require any number of the novel cushion disclosed herein. Furthermore, the foregoing list of suitable furniture seating systems is by no means intended to be comprehensive and it is fully contemplated that the novel cushion disclosed herein may be incorporated in a wide variety of other types of furniture seating systems. Finally, it is further contemplated that the novel cushion disclosed herein is equally suitable for stand alone use, for example, as a pillow, for use as part of another type of furniture system, for example, as a mattress of a sleep system, or as part of one or more of any number of non-furniture applications not specifically recited herein.

In FIG. 1, the furniture seating system 100 includes an upholstered support frame which includes a base support portion 120, a back support portion 130, a first side support portion 140 and a second side support portion 150 which collectively define the upholstered support frame 110 which supports plural cushions which also form part of the furniture seating system 100. As disclosed herein, the upholstered support frame 100 and the cushions are sized such that first and second seat cushions 160 are supported on top of the base support portion 120 and positioned between the first and second side support portions 140 while first and second back cushions 180 (one of which has been removed to better show the first seat cushion 160) are supported by the base support portion 120 and top side surfaces of the first and second seat cushions 160 and 170 and positioned between the first and second side support portions 140 and 150. Typically, the furniture seating system 100 will include additional pillows, for example, throw pillows, which, while easily repositioned, are typically placed such that they are supported by a selected one of the first and second side support portions 140 and 150, either alone, or in combination with an adjacent one of the first and second seat cushions 160 and 170.

Referring next to FIG. 2, the seat cushion 160 will now be described in greater detail. As will be more fully described below, the seat cushion 160 is uniquely configured to include plural portions (or "zones), each having a discrete compressibility characteristic which provides the seat cushion 160 with a number of advantages in contrast to conventional seat cushions characterized by a uniform compressibility characteristic. While previously stated, it should again be emphasized that, while the description which follows is directed to a seat cushion uniquely configured to include plural zones having discrete compressibility characteristics, it should be clearly understood that the novel concepts disclosed herein are equally applicable to other types of resilient structures, particularly those used for personal comfort such as, for example, a furniture back, a comforter or a pillow. As will also be more fully described below, to provide the seat cushion 160 with plural zones, each having a discrete compressibility characteristic, the seat cushion 160 is variously constructed using combinations of fiber and foam materials. It should be clearly understood that it is entirely possible to construct a seat cushion having plural compressibility zones using other types of materials as well if multiple types of materials, each having a different compressibility characteristic, are used.

Referring now to FIG. 2, the seat cushion 160 includes an upper side surface 200, a lower side surface 210, a front side surface 220 and a back side surface 230. Typically, the upper side surface 200 is used as a seating area, the lower side surface 210 is placed against an upper side surface of the base support portion 120, the back side surface 230 is placed against an exterior side surface of the back support portion 130 and the front side surface 220 remains visible. Upholstery or other suitable fabric or decorative material (not shown) covers the entire seat cushion 160 to provide a decorative touch. In use, for example, when a person sits on the upper side surface 200 of the seat cushion 160, a forward portion of the seat cushion 160 (denoted in FIG. 2 as portion "A") supports the knee area of the user, an intermediate portion of the seat cushion 160 (denoted in FIG. 2 as portion "B") supports the bulk of the weight of the user and a back portion of the seat cushion 160 (denoted in FIG. 2 as portion "C") supports the posterior of the user. It should be noted, however, that the boundaries separating the portions A, B and C of the seat cushion 160 are purely illustrative and are subject to shifts, for example, if the user leans forward, slouches, or otherwise shifts their weight while remaining seated on the seat cushion 160. The boundaries A, B and C do, however, provide a useful guideline when analyzing the distribution of weight on the seat cushion 160.

Continuing to refer to FIG. 2, the seat cushion 160 is comprised of an inner core 240, a first intermediate layer 250, a second intermediate layer 260 and a surrounding outer layer 270. In the embodiment disclosed herein, the inner core 240 is formed of a foam material, has a thickness of about four inches and a relative firmness of 1.5. In this regard, it should be noted that a current convention is to provide firmness values for foam compositions as a comparative value relative to other foam compositions. In accordance with this convention, a larger number indicate greater firmness for one foam composition relative to other foam compositions having smaller numbers while a smaller number indicate lesser firmness for the first foam relative to other foam compositions having larger numbers. Each of the first and second intermediate layers 250 and 260 is formed of a fiber batt having a thickness of about ¾ inches and a density of about 1.6 ounces per square foot of the ¾ inch thick fiber batt.

The foam inner core 240 is positioned below the first intermediate fiber batt 250 and above the second intermediate fiber batt 260 in a "sandwich" configuration in which a lower side surface of the foam inner core 240 is laid on an upper side surface of the second intermediate fiber batt 260 and a lower side surface of the first intermediate fiber batt 250 is laid on an upper side surface of the foam inner core 240. The outer layer 270 is wrapped around the second intermediate fiber batt 260, the foam inner core 240 and the first intermediate fiber batt 250. To wrap the second intermediate fiber batt 260, the foam inner core 240 and the first intermediate fiber batt 250, the outer layer would, for example, be dimensioned to be about 2½ longer than the first intermediate fiber batt 250, foam inner core 240 or the second intermediate fiber batt 260, respectively. The outer layer 270 would then be laid against an upper side surface of the first intermediate fiber batt 250, a front side surface of the first intermediate fiber batt 250, a front side surface of the foam inner core 240, a front side surface of the second intermediate fiber batt 260 and a lower side surface of the second intermediate fiber batt 260. The outer layer 270 is formed of a fiber batt having a thickness of about 2 inches and a density of about 2 ounces per square foot of the two inch thick fiber batt. Thus, that portion, generally designated in FIG. 2 as portion 270-1, of the outer fiber batt 270 positioned above the first intermediate fiber batt 250 is about 2 inches thick while that portion, generally designated in FIG. 2 as portion 270-2, of the outer fiber batt 270 positioned below the second intermediate fiber batt 260 is also about 2 inches thick.

It should be noted that, as previously set forth, the density of a fiber batt is traditionally measured in ounces per square foot per thickness of the batt. By way of examples and not as a limitation to the scope of the invention, fiber batt densities can include less than one (1) ounce per square foot per inch of thickness to over five (5) ounces per square foot per inches of thickness. In general, a high loft, low density fiber batt has a ratio of density to thickness of about 1 to 1. It should be understood that the examples provided herein are illustrations of suitable densities for the fiber batts and not limitations to the scope of the invention. Rather, it is contemplated that the scope of the invention includes density combinations that provide relatively high densities for the intermediate fiber batts and relatively low densities for the softer outer fiber batts.

It is noted that the density, as a measure of weight per unit volume, of the outer fiber layer 270 is less than the density of the first and second intermediate fiber layers 250 and 260. Accordingly, the outer fiber layer 270 may be deemed, relative to the first and second intermediate fiber layers 250 and 260, as relatively high loft, low density fiber batt while the first and second intermediate fiber layers may be deemed, relative to the outer layer 270, as a relatively low loft, high density fiber batt. Furthermore, it is noted that a denser batt is relatively firm, while a less dense batt is relatively soft. As a result, the first and second intermediate fiber batts 250 and 260 may be referred to as the "firmer" fiber batts while the outer fiber batt 270 may be referred to as "softer" fiber batts.

In the embodiment illustrated in FIG. 2, portions 270-1 and 270-2 of the outer fiber layer 270 are formed from a common fiber and, as a result, have generally identical densities and thicknesses. However, the same relationships between the portion 270-1 of the outer fiber layer 270 relative to the first intermediate fiber layer 250 and between the portion 270-2 of the outer fiber layer 270 relative to the second intermediate fiber layer 260 could instead be achieved using separate fiber batts, each having a different density and thickness, for the portions 270-1 and 270-2, respectively, so long as the relationship of the density of the portions 270-1, 270-2 relative to the first and second intermediate fiber layers 250, 260, remain the same. In the same vein, as long as the desired relationships relative to the portions 270-1 and 270-2 are maintained, similar results may be achieved regardless of whether the first and second intermediate fiber layers 250 and 260 have the same or different density and thicknesses.

While one configuration has been disclosed herein, it is contemplated that the thickness and density or firmness of each of the first intermediate fiber batt 250, the second intermediate fiber batt 260, the outer fiber batt 270 and the foam inner core 240 can be of any design suitable for the desired characteristics of the seat cushion 160. Factors to consider in designing suitable thicknesses and densities include, without limitation, softness or plushness, the desired level of support for the back, seat and body, and the overall thickness desired for the seat cushion 160. The firmer first intermediate fiber batt 250, the second intermediate fiber batt 260 and the foam inner core 240 are resiliently compressible to a lesser degree than the softer outer fiber batts to provide support for a given load, for example, to someone sitting on the resilient structure, and also provide ease in raising oneself up from a seated position. In addition, the firmer first intermediate fiber batt 250, the second intermediate fiber batt 260 and the foam inner core 240 provide stability to the resilient structure. The first and second intermediate fiber batts 250 and 260 also provide stability to the foam inner core 240 by forestalling its disintegration, thus imparting further durability to the foam inner core 240 and to the set cushion 160 as a whole. The softer outer fiber batt 270 is resiliently compressible, cushiony, and imparts a soft plush feel to the touch. As a result, the seat cushion 160 is characterized by a soft plush feel to the touch and a firmer interior support.

It is further noted that the thickness of each of the first and second intermediate fiber batts 250 and 260, the outer fiber batt 270 and the foam inner core 240, as well as the seat cushion 160 itself, can be any dimension suitable to achieve the desired characteristics for a personal comfort item. Factors to consider in selecting suitable thicknesses include, without limitation, the desired softness or plushness, the support required and the overall desired thickness for the seat cushion 160. For a seat cushion where softness to the touch and a sense of plushness are desirable features, a relatively thicker outer fiber batt where firmer is suitable. For a seat cushion where firmer support is desired, a relatively thicker foam core or intermediate fiber batts would be appropriate. By way of example and not by way of limitation, the thickness of the foam inner core 240 which forms the interior of the seat cushion 160 could range anywhere from less than 1 inch to provide relatively little support to thicknesses of approximately 12 inches which would provide relatively firm support. Other suitable ranges for a foam inner core 240 would include thicknesses of 1 inch to 6 inches and thicknesses of approximately 3 to 4 inches. The thickness of each of the intermediate fiber batts 250 and 260 can range from ¼ of an inch to 12 inches, and from ¾ of an inch to 2 inches. Again by way of example and not as a limitation, the thickness of the relatively low density high loft outer fiber batt 270 could range anywhere from 2 inches to 8 inches to provide, respectively, an increasing sense of softness for the personal comfort item. Another suitable thickness for the outer fiber batt is about 4 inches. It is further contemplated that each of the first intermediate fiber batt 250, the second intermediate fiber batt 260 and the outer fiber batt 270 can be the same thickness or can be different, as appropriate for the desired personal comfort characteristics of the seat cushion. Again, it should clearly be understood that the above ranges of absolute thicknesses are provided by way of example and not as limitations to the scope of the present invention.

For a complete understanding of the invention, a brief discussion of the composition of the various fiber batts described and illustrated herein, shall now follow. Both high loft and low loft fiber batts are conventionally comprised of nonwoven carrier fibers that can be a blend of various types of fibers, including synthetic and natural fibers. In general, a different proportion or selection of fibers for the fiber batts can result in different densities. The fiber batts can further comprise low melting temperature binder fibers should a conventional thermal bonding process be used in their construction. Methods for manufacturing the batts are generally known to those skilled in the art and include reducing a fiber bale to its individual separated fibers using a picker that fluffs the fibers. The fluffed fibers are homogeneously mixed with other separated fibers to create a matrix or web that has a very low density. A garnet machine then cards the fiber mixture into layers to achieve a fiber batt having the desired weight or density. Density may be further increased by piercing the matrix with a plurality of needles to drive a portion of the retained air therefrom. The webs are thermally processed into fiber batts, as is customary in the industry. The thermal process includes heating the fiber web structure at a temperature sufficient to melt the low melting temperature fibers but low enough to avoid melting the other fibers of the web. The fiber web structure is compressed and then cooled to form the fiber batt. Each web can be thermally processed separately into a batt, or alternatively, the webs for an intermediate and an outer fiber batt can be overlaid and thermally processed simultaneously. The foam core can then be sandwiched between and bonded to two composite intermediate and outer fiber batts to form the resilient structure. Should each fiber web be processed separately into a fiber batt, the foam core can be sandwiched between the intermediate fiber batts or between the outer fiber batts to create the desired resilient structure. The foam core and fiber batts are bonded or laminated together to form the resilient structure. Bonding or lamination can be achieved with glue, adhesives, resins or other bonding agents which can be sprayed, painted or otherwise applied to the fiber batts and foam.

The fiber web structures can also be processed into fiber batts using resin rather than low melting temperature binder fibers. The fiber web structure is saturated with a heat curable resin. Heat is applied at a temperature sufficient to cure the resin and fuse the fibers to form a batt having a density and thickness substantially the same as that during the heating step.

Referring next to FIG. 3A, a cross-sectional view of a second embodiment of a seat cushion 300 constructed, in accordance to the teachings of the present invention, to have plural zones, each having a discrete compressibility characteristic, will now be described in greater detail. As may now be seen, the seat cushion 300 includes an upper side surface 310, a lower side surface 320, a front side surface 330 and a back side surface 340. Typically, the upper side surface 310 is used as a seating area, the lower side surface 320 is placed against an upper side surface of the base support portion 120, the back side surface 340 is placed against an exterior side surface of the back support portion 130 and the front side surface 330 remains visible. Upholstery or other suitable fabric or decorative material (not shown) covers the entire seat cushion 300 to provide a decorative touch. In use, for example, when a person sits on the upper side surface 310 of the seat cushion 300, a forward portion of the seat cushion 300 (denoted in FIG. 3A as portion "A") supports the knee area of the user, an intermediate portion of the seat cushion 300 (denoted in FIG. 3A as portion "B") supports the bulk of the weight of the user and a back portion of the seat cushion 300 (denoted in FIG. 3A as portion "C") supports the posterior of the user.

Continuing to refer to FIG. 3A, the seat cushion 300 is comprised of an inner core 350, an intermediate layer 360 and a surrounding outer layer 370. In the embodiment disclosed herein, the inner core 350 is formed of a foam material, has a total thickness of about four inches and a relative firmness of 1.5. The intermediate layer 360 is formed of a fiber batt having a thickness of about ¾ of an inch and a density of about 1.6 ounces per square foot of the ¾ inch thick fiber batt. The intermediate fiber layer 360 is positioned within the foam inner core 350 to form a fiber subcore. It is contemplated that the fiber subcore 360 can be positioned at any depth within the foam inner core 350. In the embodiment illustrated in FIG. 3A, the fiber subcore 360 is positioned approximately one inch below the upper side surface of the foam inner core 350. Thus, in the illustrated embodiment, there is about one inch of foam above the fiber subcore 360 and about three inches of foam beneath the fiber subcore 360. Preferably, the illustrated configuration is formed by segmenting the foam inner core 350 into two portions, laying the fiber subcore 360 onto a three inch thick portion of the foam inner core 350 and then laying a one inch thick portion of the foam inner core 350 onto the fiber subcore 360.

Figure 3B:
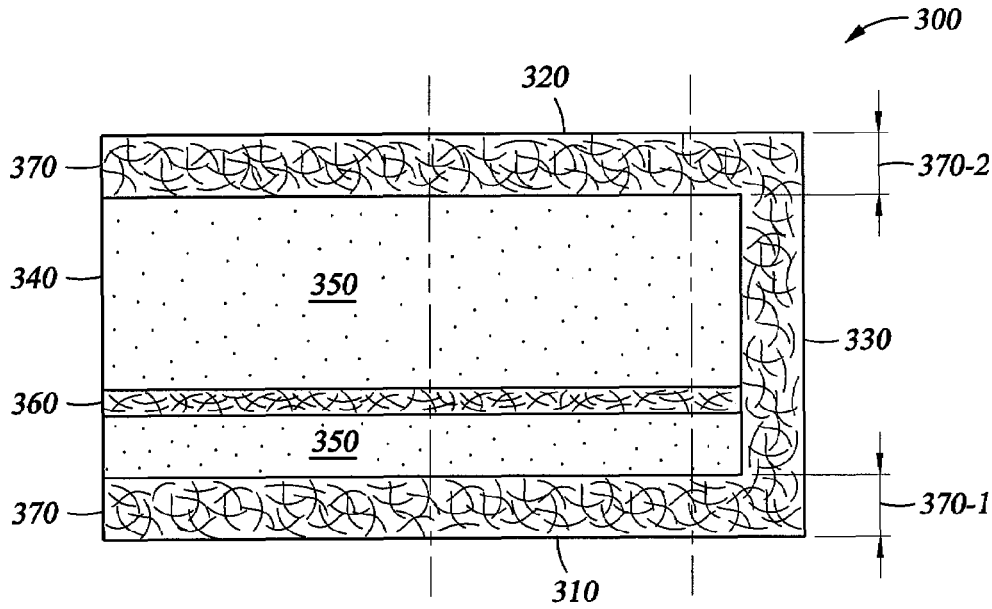

A different feel will be noticed by a user who sits on the upper side surface 310 of the seat cushion 300 when positioned as shown in FIG. 3A and when the same user sits on the lower side surface 320 of the seat cushion when positioned as shown in FIG. 3B. The different feels are achieved by varying depth of the fiber subcore 360 within the foam inner core 350. Should the fiber subcore 360 be positioned at the general center of the foam inner core 350, the feel to the user sitting on the upper side surface 310 of the seat cushion 300 will be about the same as the feel to the user when sitting on the lower side surface 320 of the seat cushion 300.

The foam inner core 350 (with fiber subcore 360 therein) is wrapped by the outer layer 370 in the same manner previously described with respect to FIG. 2. The outer layer 370 is formed from a fiber batt having a thickness of about 2 inches thick and a weight of about 2 ounces per square foot of the 2 inch thick fiber batt. Thus, that portion, generally designated in FIGS. 3A–B as portion 370-1, of the outer fiber batt 370 positioned above the foam inner core 350 is about 2 inches thick while that portion, generally designated in FIGS. 3A–B as portion 370-2, of the outer layer 370 positioned below the foam inner core 350 is also about 2 inches thick.

Referring next to FIG. 4, a cross-sectional view of a third embodiment of a seat cushion 400 constructed, in accordance with the teachings of the present invention, to have plural zones, each having a discrete compressibility characteristic, will now be described in greater detail. As may now be seen, the seat cushion 400 includes an upper side surface 410, a lower side surface 420, a front side surface 430 and a back side surface 440. Typically, the upper side surface 410 is used as a seating area, the lower side surface 420 is placed against an upper side surface of the base support portion 120, the back side surface 440 is placed against an exterior side surface of the back support portion 130 and the front side surface 430 remains visible. Upholstery or other suitable fabric or decorative material (not shown) covers the entire seat cushion 400 to provide a decorative touch. In use, for example, when a person sits on the upper side surface 410 of the seat cushion 400, a forward portion of the seat cushion 400 (denoted in FIG. 4 as portion "A") supports the knee area of the user, an intermediate portion of the seat cushion 400 (denoted in FIG. 4 as portion "B") supports the bulk of the weight of the user and a back portion of the seat cushion 400 (denoted in FIG. 4 as portion "C") supports the posterior of the user.

Continuing to refer to FIG. 4, the seat cushion 400 is comprised of an inner core 450, an intermediate layer 460 and a surrounding outer layer 470. In the embodiment disclosed herein, the inner core 450 is formed of a foam material, has a total thickness of about three inches and a relative firmness of 1.8. The intermediate layer 460 is formed of a fiber batt having a thickness of about 2 inches and a density of about 4 ounces per square foot of the 2 inch thick fiber batt. The intermediate fiber layer 460 is positioned within the foam inner core 450 to form a fiber subcore. It is contemplated that the fiber subcore 460 can be positioned at any depth within the foam inner core 450. In the embodiment illustrated in FIG. 4, the fiber subcore 460 is positioned generally equidistant within the foam inner core 450, more specifically, an upper side surface 460*a* of the fiber subcore 460 is positioned at a distance of about 1 ½ inches below an upper side surface 450*a* of the foam inner core 450 and a lower side surface 460*b* of the fiber subcore 460 is positioned at a distance of about 1 ½ inches above a lower side surface 450*b* of the foam inner core 450. Preferably, the illustrated configuration is formed by segmenting the foam inner core 450 into two portions, each having a thickness of approximately 1 ½ inches, laying the fiber subcore 460 onto a first 1 ½ inch thick portion of the foam inner core 450 and then laying a second 1 ½ thick portion of the foam inner core 450 onto the fiber subcore 460.

By placing the fiber subcore 460 at a position equidistant from both the upper and lower side surfaces 450*a* and 450*b* of the foam inner core 450, the seat cushion 400 has a feel quite distinct when compared to the seat cushion 300. More specifically, in contrast to the distinct feels obtained by sitting on the upper and lower side surfaces 310 and 320 of the seat cushion 300, the feel to a user sitting on the upper side surface 410 of the seat cushion 400 will be about the same as the feel to the user when sitting on the lower side surface 420 of the seat cushion 400.

The foam inner core 450 (with fiber subcore 460 therein) is wrapped by the outer layer 470 in the same manner previously described with respect to FIG. 2. The outer layer 470 is formed from a fiber batt having a thickness of about 2 inches thick and a weight of about 2 ounces per square foot of the 2 inch thick fiber batt. Thus, that portion, generally designated in FIG. 4 as portion 470-1, of the outer fiber batt 470 positioned above the foam inner core 450 is about 2 inches thick while that portion, generally designated in FIG. 4 as portion 470-2, of the outer layer 470 positioned below the foam inner core 450 is also about 2 inches thick.

Referring next to FIG. 5, a cross-sectional view of a fourth embodiment of a seat cushion 500 constructed, in accordance with the teachings of the present invention, to have plural zones, each having a discrete compressibility characteristic, will now be described in greater detail. As may now be seen, the seat cushion 500 includes an upper side surface 510, a lower side surface 520, a front side surface 530 and a back side surface 540. Typically, the upper side surface 510 is used as a seating area, the lower side surface 520 is placed against an upper side surface of the base support portion 120, the back side surface 540 is placed against an exterior side surface of the back support portion 130 and the front side surface 530 remains visible. Upholstery or other suitable fabric or decorative material (not shown) covers the entire seat cushion 500 to provide a decorative touch. In use, for example, when a person sits on the upper side surface 510 of the seat cushion 500, a forward portion of the seat cushion 500 (denoted in FIG. 5 as portion "A") supports the knee area of the user, an intermediate portion of the seat cushion 500 (denoted in FIG. 5 as portion "B") supports the bulk of the weight of the user and a back portion of the seat cushion 500 (denoted in FIG. 5 as portion "C") supports the posterior of the user.

Continuing to refer to FIG. 5, the seat cushion 500 is comprised of an inner core 550, an intermediate layer 560 and a surrounding outer layer 570. In the embodiment disclosed herein, the inner core 550 is formed of a foam material, has a total thickness of about five inches and a relative firmness of 1.8. The intermediate layer 560 is formed of a fiber batt having a thickness of about 1 inches and a density of about 2 ounces per square foot of the 1 inch thick fiber batt. As may be seen in FIG. 5, the intermediate fiber batt 560 is wrapped around a portion of the foam inner core 550. More specifically, the intermediate fiber batt covers a forward portion 550*b*-1 of a lower side surface 550*b* a front side surface 550*c* and a forward portion 500*a*-1 of an upper side surface 550*a* of the foam inner core 550. By configuring the seat cushion 500 in this manner, the forward portion A of the foam inner core 550 which, as previously set forth, provides support to the knee area of user sitting on the upper side surface 510 of the seat cushion 500 is covered by the intermediate fiber batt 560.

By placing the intermediate fiber batt 560 around the forward portion A of the foam inner core 550, a zone of additional support is provided for the knees of a user sitting on the upper side surface 510 of the seat cushion 500. Providing additional support for the knees of the user is particularly useful because the forward portion A of the seat cushion 500 tends to bear a larger load than other portions of the seat cushion 500, for example, the intermediate portion B which typically bears the load produced by the thighs when the user sits on the upper side surface 510 of the seat cushion 500. It is further contemplated that other zones of additional support could be provided by the strategic placement of the intermediate fiber batt 560 in locations other than that illustrated in FIG. 5. For example, the intermediate fiber batt could instead be placed around the back portion C of the foam inner core 550 to provide additional support for the posterior of the user or first and second intermediate fiber batts could be placed along the left and right sides (not shown) of the foam inner core 550 to stabilize the seat cushion. These additional placements of the intermediate fiber batt may be used in place of the placement of the intermediate fiber batt 560 illustrated in FIG. 5. Alternately, these additional placements may be used in addition to the intermediate fiber batt 560, for example, by positioning plural intermediate fiber batts 560 within the seat cushion 500.

The foam inner core 550 and the intermediate fiber batt 560 are wrapped by the outer layer 570 in the same manner previously described with respect to FIG. 2. The outer layer 570 is formed from a fiber batt having a thickness of about 2 inches thick and a weight of about 2 ounces per square foot of the 2 inch thick fiber batt. Thus, that portion, generally designated in FIG. 5 as portion 570-1, of the outer fiber batt 570 positioned above the foam inner core 550 is about 2 inches thick while that portion, generally designated in FIG. 5 as portion 570-2, of the outer layer 570 positioned below the foam inner core 550 is also about 2 inches thick. As previously noted, the intermediate fiber batt 560 has a thickness of about 1 inch. To accommodate the intermediate fiber batt 560 during the wrapping process without having to compress either the intermediate fiber batt 560 or the outer fiber batt 570, it is contemplated that the outer fiber batt 570 may be reduced to a thickness of 1 inch for that portion which covers the intermediate fiber batt 560. If configured in this manner, the seat cushion would still be characterized by additional support in the forward portion A because the intermediate fiber batt 560 has a weight of 2 ounces per square foot of the 1 inch thick fiber while the outer fiber batt 570 has a weight of 2 ounces per square foot of the 2 inch fiber batt. Thus, combining the two produces, within the portion A of the seat cushion 500, a composite fiber batt having a weight of three ounces per square foot of the two inch thick whereas, within the portions B and C of the seat cushion, the outer fiber batt 570-has a weight of two ounces per square foot of the 2 inch fiber batt.

While illustrative drawings and examples have been shown and described, various modifications and substitutions may be made thereto without departing from the spirit and scope of the invention. Those skilled in the art will readily see other embodiments within the scope of the invention. Accordingly it is to be understood that the resilient structure of the present invention has been described by way of illustration only and not by way of limitation.

What is claimed is:

1. A resilient structure comprising:

a foam core;

an intermediate layer of fiber batt positioned within the foam core to create a fiber subcore;

a first and a second outer layer of fiber batt, wherein said foam core is between said first and said second outer layers of fiber batt and said intermediate fiber batt has a density which is greater than the densities of said first and said second outer fiber batts.

2. The resilient structure of claim 1 wherein the foam core has a thickness of approximately 4 inches, the intermediate fiber batt has a thickness of about ¾ inches and a density of about 1.6 ounces per square foot per its thickness and is positioned within the interior of the foam core at a depth of about 1 inch, and each of the outer fiber batts has a thickness of about 2 inches and a density of about 2 ounces per square foot per its thickness.

3. The resilient structure of claim 1 wherein the foam core has a thickness of approximately 3 inches, the intermediate fiber batt has a thickness of about 2 inches and a density of about 4 ounces per square foot per its thickness and is positions within the interior of the foam core at a depth of about 1.5 inches, and each of the outer fiber batts has a thickness of 2 inches and a density of about 2 ounces per square foot per its thickness.

4. A resilient structure, comprising:

a foam core having top and bottom side surfaces, said foam core having a fiber subcore positioned between said top and bottom side surfaces thereof; and a fiber batt wrapped around said foam core.

5. The resilient structure of claim 4, wherein said fiber subcore is positioned equidistant between said top and bottom side surfaces of said foam core.

6. The resilient structure of claim 4, wherein:

said foam core further comprises a side surface;

said fiber batt further comprises a bottom side surface; and said bottom side surface of said fiber batt engaging said top, bottom and side surfaces of said foam core.

7. The resilient structure of claim 6, wherein:

said fiber subcore further comprises a side surface; and said bottom side surface of said fiber batt engaging said side surface of said fiber subcore.

8. The resilient structure of claim 7, wherein said fiber subcore is a second fiber batt.

9. The resilient structure of claim 4, wherein said fiber subcore is positioned closer to said top side surface of said foam core than to said bottom side surface of said foam core.

10. The resilient structure of claim 9, wherein:

said foam core further comprises a side surface;

said fiber batt further comprises a bottom side surface; and said bottom side surface of said fiber batt engaging said top, bottom and side surfaces of said foam core.

11. The resilient structure of claim 10, wherein:

said fiber subcore further comprises a side surface; and said bottom side surface of said fiber batt engaging said side surface of said fiber subcore.

12. The resilient structure of claim 11, wherein said fiber subcore is a second fiber batt.

13. The resilient structure of claim 4, wherein said fiber subcore is positioned closer to said bottom side surface of said foam core than to said top side surface of said foam core.

14. The resilient structure of claim 13, wherein:

said foam core further comprises a side surface;

said fiber batt further comprises a bottom side surface; and said bottom side surface of said fiber batt engaging said top, bottom and side surfaces of said foam core.

15. The resilient structure of claim 14, wherein:

said fiber subcore further comprises a side surface; and said bottom side surface of said fiber batt engaging said side surface of said fiber subcore.

16. The resilient structure of claim 15, wherein said fiber subcore is a second fiber batt.

17. The resilient structure of claim 4, wherein:

said foam core is comprised of a first portion having top and bottom side surfaces and a second portion having top and bottom side surfaces; and said fiber subcore is positioned between said bottom side surface of said first portion of said foam core and a top side surface of a second portion of said foam core.

18. The resilient structure of claim 4 wherein the distance separating said top and bottom side surfaces of said first portion of said foam core is generally equal to the distance separating said top and bottom side surfaces of said second portion of said foam core.

19. The resilient structure of claim 4 wherein the distance separating said top and bottom side surfaces of said first portion of said foam core is greater than the distance separating said tope and bottom side surfaces of said second portion of said foam core.

20. The resilient structure of claim 4 wherein the distance separating said top and bottom side surfaces of said first portion of said foam core is less than the distance separating said top and bottom side surfaces of said second portion of said foam core.

* * * * *

UNITED STATES PATENT AND TRADEMARK OFFICE

CERTIFICATE OF CORRECTION

PATENT NO. : 7,238,630 B2
APPLICATION NO. : 10/773832
DATED : July 3, 2007
INVENTOR(S) : Steagall et al.

It is certified that error appears in the above-identified patent and that said Letters Patent is hereby corrected as shown below:

Title Page item (75), Inventors, please add after "Karl" the initial --L--

Col. 6, line 63, replace "garnet" with --gamett--

Col. 11, line 27, replace "positions" with --positioned--

Col. 12, line 37, replace "claim 4" with --claim 17--

Col. 12, line 42, replace "claim 4" with --claim 17--

Col. 12, line 45, replace "tope" with --top--

Col. 12, line 47, replace "claim 4" with --claim 17--

Signed and Sealed this

Twenty-fifth Day of November, 2008

JON W. DUDAS
*Director of the United States Patent and Trademark Office*